US007453430B2

(12) United States Patent
Park et al.

(10) Patent No.: US 7,453,430 B2
(45) Date of Patent: Nov. 18, 2008

(54) FIELD SEQUENTIAL LIQUID CRYSTAL DISPLAY AND A DRIVING METHOD THEREOF

(75) Inventors: Jin-Woo Park, Suwon-si (KR); Tae-Soo Kim, Suwon-si (KR); Tae-Hyeog Jung, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 710 days.

(21) Appl. No.: 11/126,661

(22) Filed: May 10, 2005

(65) Prior Publication Data

US 2005/0259059 A1 Nov. 24, 2005

(30) Foreign Application Priority Data

May 18, 2004 (KR) ..... 10-2004-0035139

(51) Int. Cl.
*G09G 3/34* (2006.01)

(52) U.S. Cl. ..... 345/89; 345/87; 345/88

(58) Field of Classification Search ..... 345/87–100, 345/204, 208–212, 214
See application file for complete search history.

(56) References Cited

U.S. PATENT DOCUMENTS 5,805,126 A * 9/1998 Bassetti ..... 345/89
7,042,430 B2 * 5/2006 Isami et al. ..... 345/89

FOREIGN PATENT DOCUMENTS

JP 2000-259130 9/2000
KR 2001-0107315 12/2001

OTHER PUBLICATIONS

Patent Abstracts of Japan, Publication No. 2000-259130; Publication Date: Sep. 22, 2000; in the name of Nakajima et al.
Korean Patent Abstracts, Publication No. 1020010107315; Publication Date: Jul. 12, 2001; in the name of Kim et al.

* cited by examiner

*Primary Examiner*—Richard Hjerpe
*Assistant Examiner*—Mansour M Said
(74) *Attorney, Agent, or Firm*—Christie, Parker & Hale, LLP

(57) ABSTRACT

A liquid crystal display and a driving method thereof. A liquid crystal is disposed between a first substrate and a second substrate, and R, G, and B color lights are sequentially applied to a plurality of pixels. A first common voltage and a first gray scale waveform corresponding to first gray scale data are applied to a first pixel in a field of a current frame, and a gray scale having a level half-way between gray scale levels of the first and second gray scale data is displayed by applying a second common voltage and a second gray scale waveform corresponding to the second gray scale data in the field of a next frame. The gray scale levels of the first and second gray scale data are different from each other by one level. By displaying gray scales having half-way levels, a milder screen having more smooth transitions between pixel intensities can be realized.

9 Claims, 4 Drawing Sheets

FIELD SEQUENTIAL LIQUID CRYSTAL DISPLAY AND A DRIVING METHOD THEREOF

CROSS REFERENCE TO RELATED APPLICATION

This application claims priority to and the benefit of Korean Patent Application No. 10-2004-0035139 filed on May 18, 2004 in the Korean Intellectual Property Office, the entire content of which is incorporated herein by reference.

BACKGROUND OF THE INVENTION

1. Field of the Invention

The present invention relates to a liquid crystal display and a driving method thereof. More particularly, the present invention relates to a field sequential driving type of liquid crystal display (LCD) and a driving method thereof.

2. Description of the Related Art

As personal computers and televisions, etc., have become more lightweight and thin, the demand for lightweight and thin display devices has increased. According to such requirements, flat panel displays such as LCDs have recently been developed for use instead of cathode ray tubes (CRT).

An LCD is a display device used to display images corresponding to a desired video signal by applying electric fields to liquid crystal materials having an anisotropic dielectric constant and injected between two substrates, and controlling the strength of electric fields so as to control an amount of light from an external light source (i.e., backlight) transmitted through the substrates.

The LCD is representative of portable flat panel displays, and TFT-LCDs using a thin film transistor (TFT) as a switch are mainly used.

Each pixel in the TFT-LCD can be modeled with a capacitor having liquid crystal as a dielectric substance, such as a liquid crystal capacitor. An equivalent circuit of each pixel in such an LCD is shown in FIG. 1.

As shown in FIG. 1, each pixel of an LCD includes a TFT 10, of which a source electrode and a gate electrode are respectively connected to a data line Dm and a scan line Sn, a liquid crystal capacitor Cl connected between a drain electrode of the TFT 10 and common voltage Vcom, and a storage capacitor Cst connected to the drain electrode of the TFT 10.

In FIG. 1, when a scan signal is applied to the scan line Sn and the TFT 10 is turned on, data voltages Vd supplied to the data line Dm are applied to a pixel electrode (not shown) though the TFT 10. Then, an electric field corresponding to a difference between pixel voltages Vp applied to pixel electrodes and the common voltage Vcom is applied to liquid crystal (which is equivalently shown as the liquid crystal capacitor Cl in FIG. 1). Light transmits with a transmittivity corresponding to the strength of the electric field. In this instance, a pixel voltage Vp is maintained during one frame or one field, so that the storage capacitor Cst in FIG. 1 is used to maintain the pixel voltage Vp applied to the pixel electrode.

Generally, methods for driving an LCD can be classified into two methods, which are a color filter method and a field sequential driving method, based on methods of displaying color images.

An LCD using a color filter method has color filter layers composed of the three primary colors of red R, green G, and blue B in one of two substrates, and displays a desired color by controlling amount of lights transmitted through the color filter layers. An LCD using a color filter method controls an amount of light transmitted through the R, G, and B color filter layers when light from a single light source is transmitted through the R, G, and B color filter layers, and uses the R, G, and B color lights to display a desired color.

An LCD device for displaying color using a single light source and thee color filter layers uses unit pixels that respectively correspond to R, G, and B subpixels, thus at least three times the number of pixels are needed compared to displaying black and white. Therefore, fine manufacturing techniques are required to produce video images having high definition.

Further, there are problems in that separate color filter layers must be formed on a substrate for an LCD during manufacturing, and the light transmission rate of the color filters must be improved.

On the other hand, a field sequential driving type LCD sequentially and periodically turns on independent light sources of R, G, and B colors, and adds synchronized color signals corresponding to each pixel in accordance with the periodic turning on of lights to obtain full colors. That is, according to a field sequential driving type of LCD, one pixel is not divided into R, G, and B sub pixels, and lights of three primary colors outputted from R, G, and B backlights are sequentially displayed in a time-divisional manner so that the color images are displayed using an after image effect of the eyes.

The field sequential driving method can be classified as an analog driving method or a digital driving method.

The analog driving method establishes a plurality of gray scale voltages, selects one gray scale voltage corresponding to gray scale data from among the gray scale voltages, and drives a liquid crystal panel with the selected gray scale voltage to perform gray scale display with an amount of transmission corresponding to the gray scale voltage applied.

FIG. 2 shows a driving voltage and amount of light transmission of a conventional LCD using the analog driving method.

Referring to FIG. 2, a driving voltage having a V11 level is applied to the liquid crystal, and light corresponding to the driving voltage having the V11 level is transmitted through the liquid crystal in the R field period Tr for displaying an R color. A driving voltage having a V12 level is applied to the liquid crystal, and light corresponding to the driving voltage having the V12 level is transmitted through the liquid crystal in the G field period Tg for displaying a G color. Further, a V13 level driving voltage is applied to the liquid crystal, and an amount of light transmission corresponding to the V13 level is obtained. As such, a desired color image is displayed by a combination of R, G, and B lights transmitted respectively during the Tr, Tg, and Tb field periods.

With reference to FIG. 2, a period for displaying R color is the period Tr in the range of the time t1 to t2 in which R backlight emits the light; a period for displaying G color is the period Tg in the range of the time t3 to t4 in which G backlight emits the light; and a period for displaying B color is the period Tb in the range of the time t5 to t6 in which B backlight emits the light.

On the other hand, a digital driving method applies a constant driving voltage to the liquid crystal, and controls the voltage applying time to perform a gray scale display. The digital driving method maintains a constant driving voltage, and controls timing of a voltage applying state and a voltage non-applying state, so as to control a total amount of light transmitted through the liquid crystal.

FIG. 3 shows a waveform which illustrates a driving method of an LCD of a conventional digital driving method, and shows a waveform of a driving voltage and optical transmittivity of liquid crystal based on driving data having a predetermined number of bits.

Referring to FIG. 3, gray scale waveform data corresponding to each gray scale is provided with a digital signal having a predetermined number of bits, for example, a 7 bit digital signal, and a gray scale waveform according to 7 bit data is applied to the liquid crystal. Optical transmittivity of the liquid crystal is determined based on the gray scale waveform applied to perform gray scale display.

Meanwhile, researches have been undertaken to realize mild images (i.e., images having more smooth transitions of gray scale levels or pixel intensities) by displaying various gray scales during a limited time.

SUMMARY OF THE INVENTION

In an exemplary embodiment of the present invention, there is provided a field sequential driving type of liquid crystal display and a driving method thereof for achieving milder images (i.e., images having more smooth transitions between gray scale levels or pixel intensities) by displaying images having n gray scale levels using a predetermined number of bits in a digital driving method that can normally be used to display images having n/2 gray scale levels.

According to one aspect of the present invention, a driving method of a liquid crystal display device is provided. The liquid crystal display device includes a plurality of scan lines, a plurality of data lines crossing the scan lines, and a plurality of pixels formed at areas defined by the scan lines and the data lines and coupled respectively to the scan lines and the data lines. R, G, and B color lights are sequentially applied to the pixels. For each of R, G, and B fields in which the R, G, B color lights are respectively applied, a first common voltage and a first gray scale waveform corresponding to first gray scale data are applied to a first pixel among the plurality of pixels in the field of a current frame. A gray scale which has a level half-way between gray scale levels of the first gray scale data and second gray scale data is displayed by applying a second common voltage and a second gray scale waveform corresponding to the second gray scale data to the first pixel at the field of a next frame. The gray scale level of the second gray scale data is different from the gray scale level of the first gray scale data by one level.

Further, according to another aspect of the present invention, a driving method of a liquid crystal display device having a plurality of pixels is provided. Liquid crystal is disposed between a first substrate and a second substrate, and R, G, and B color lights are sequentially transmitted through the liquid crystal. The method includes: applying a first common voltage and a first gray scale waveform corresponding to first gray scale data to a first pixel among the plurality of pixels; and displaying a gray scale having a level which is half-way between gray scale levels of the first gray scale data and second gray scale data by applying a second common voltage and a second gray scale waveform corresponding to the second gray scale data to the first pixel. The gray scale level of the second gray scale data is different from the gray scale level of the first gray scale data by one level.

Further, according to yet another aspect of the present invention, a liquid crystal display device includes a liquid crystal display panel including a plurality of scan lines for applying scan signals, a plurality of data lines crossing the scan lines, a plurality of pixels formed at areas defined by the scan lines and the data lines and coupled respectively to the scan lines and the data lines. Each pixel includes a switch and a capacitor having one side coupled to the switch and the other side coupled to a common electrode. The liquid crystal display device also includes a scan driver for supplying the scan signals to the scan lines, and a gray scale voltage generator for generating a first gray scale voltage corresponding to first gray scale data for a first pixel among the plurality of pixels at a field of a current frame, and for generating a second gray scale voltage corresponding to second gray scale data for the first pixel at the field of a next frame. The second gray scale data has a gray scale level which is different by one level from a gray scale gray scale level of the first gray scale data, so as to display a gray scale which has a level that is half-way between the gray scale levels corresponding to the first and second gray scale data. In addition, the liquid crystal display device includes a common voltage generator for generating first and second common voltages, for applying the first common voltage to the common electrode when the first gray scale data is applied, and for applying the second common voltage to the common electrode when the second gray scale data is applied. The liquid crystal display device further includes a data driver for supplying first and second gray scale waveforms of the first and second gray scale voltages generated by the gray scale voltage generator to corresponding data lines; and a light source for applying R, G, and B color lights sequentially to the pixels.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
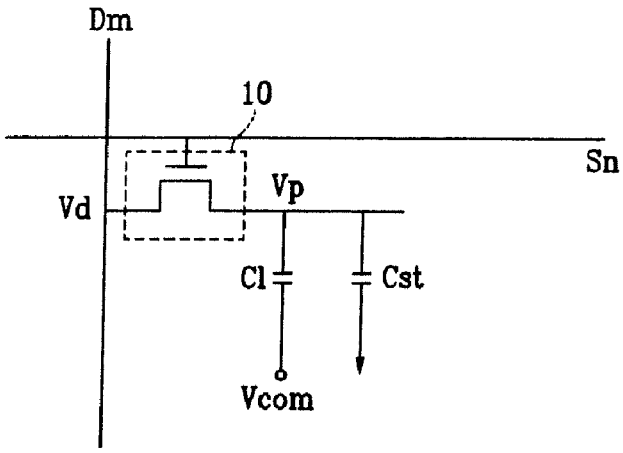
FIG. 1 PRIOR ART
FIG. 1 shows an equivalent circuit diagram of a pixel of a TFT-LCD, which can be driven using an exemplary embodiment of the present invention.
Figure 2:
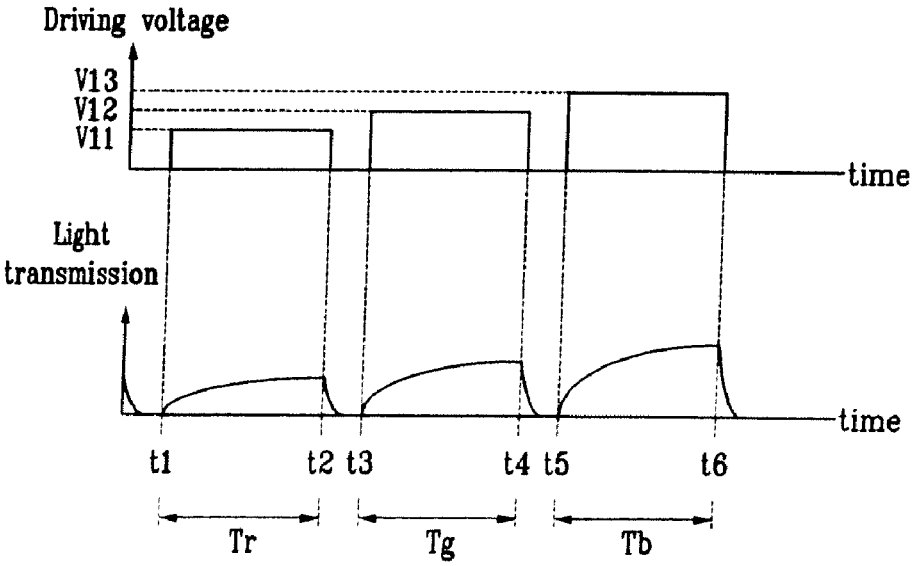
FIG. 2 PRIOR ART
FIG. 2 shows a waveform which illustrates a driving method of a liquid crystal display using a conventional analog method.
Figure 3:
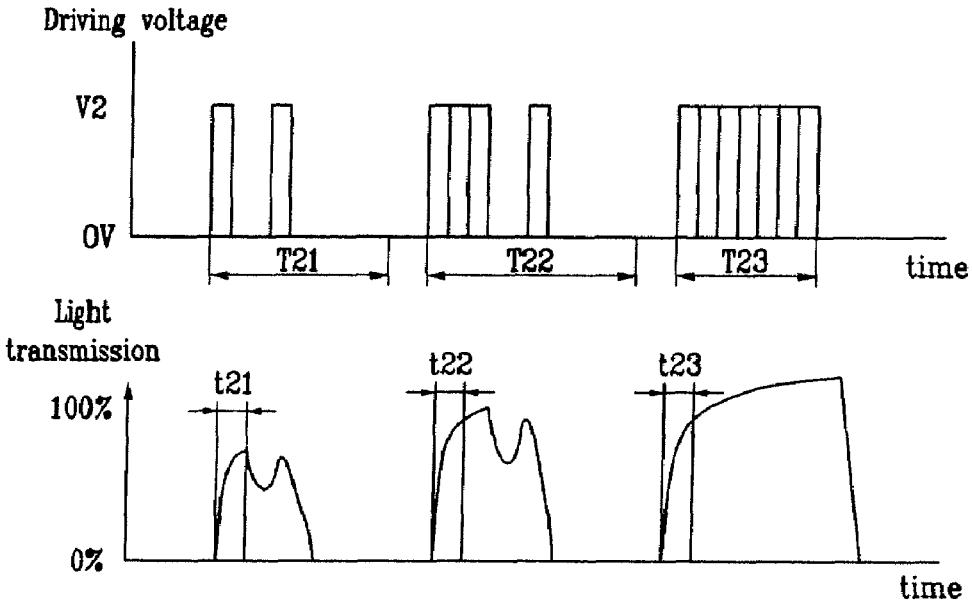
FIG. 3 PRIOR ART
FIG. 3 shows a waveform which illustrates a driving method of a liquid crystal display using a conventional digital method.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive. There may be parts shown in the drawings, or parts not shown in the drawings, that are not discussed in the specification as they are not essential to a complete understanding of the invention. Further, like elements are designated by like reference numerals.

Figure 4:
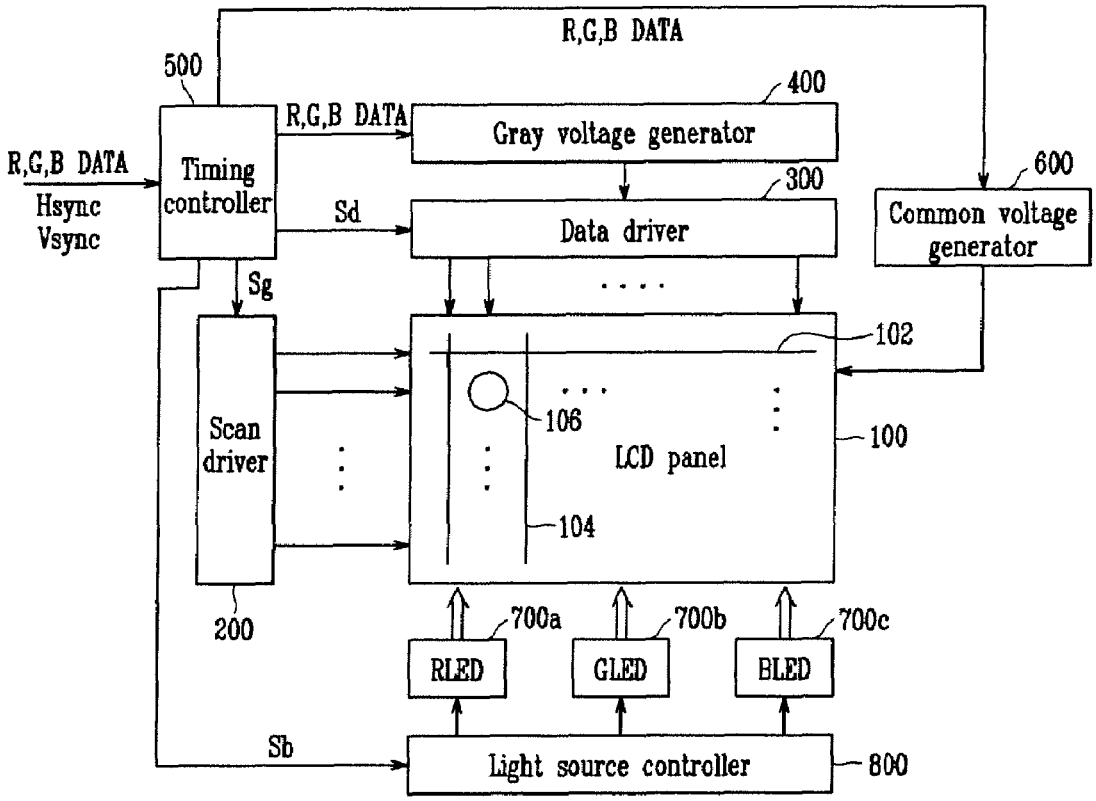
FIG. 4 shows a liquid crystal display device according to an exemplary embodiment of the present invention.

FIG. 4 shows a liquid crystal display device according to an exemplary embodiment of the present invention.

As shown in FIG. 4, a liquid crystal display device includes a liquid crystal display panel 100, a scan driver 200, a data driver 300, a gray scale voltage generator 400, a timing controller 500, a common voltage generator 600, light emitting diodes 700*a*, 700*b*, 700*c*, and a light source controller 800.

The liquid crystal display panel 100 has a plurality of scan lines 102 for transferring gate-on signals, and a plurality of data lines 104 for transferring gray scale data voltages corresponding to the gray scale data and the reset voltages and insulatively crossing the plurality of scan lines 102. The liquid crystal panel 100 further includes a plurality of pixels 106 arranged in a matrix as defined by the scan lines and data lines, each pixel including a TFT (e.g., the TFT 10 shown in FIG. 1) of which a source electrode and a gate electrode are respectively coupled with a data line 104 and a scan line 102 (e.g., Dm and Sn shown in FIG. 1), a liquid crystal capacitor (Cl shown in FIG. 1) coupled between a drain electrode of the TFT and common voltage, and a storage capacitor (Cst shown in FIG. 1) coupled to the drain electrode of the TFT.

The scan driver 200 applies the scan signals sequentially to the scan lines 102 to turn on the TFTs coupled to the scan lines 102 on which the scan signals are applied. The common voltage generator 600 applies the common voltage to the liquid crystal capacitors.

The timing controller 500 supplies suitable control signals Sg, Sd, Sb of gray scale data signals (R, G, B DATA), horizontal synchronization signals (Hsync), and vertical synchronization signals (Hsync) input from external or graphic controllers (not shown) to the scan driver 200, the data driver 300, and the light source controller 800, respectively, and supplies gray scale data signals R, G, B DATA to the gray scale voltage generator 400.

The gray scale voltage generator 400 generates the gray scale voltage corresponding to the gray scale data and supplies the same to the data driver 300. At this time, so as to realize a gray scale level which is half-way between two adjacent gray scale levels that can normally be represented using a predetermined number of bits in a digital driving method, the first gray scale voltage corresponding to the first gray scale data is generated at the field of the current frame, and the second gray scale voltage corresponding to the second gray scale data which is lower than the first gray scale data by one level is generated at the field of the next frame so that the generated gray scale voltages are supplied to the data driver 300.

The common voltage generator 600 converts the level of the common voltage at each field and applies the common voltage to the TFT. That is, when the first gray scale voltage for a first pixel is supplied to the data driver 300 at a field of the present frame, the first common voltage is generated and applied to the pixels, and when the second gray scale voltage for the first pixel is supplied to the data driver 300 at the field of a next frame, the second common voltage is generated and applied to the pixels so that the first and second common voltages are supplied to the TFT.

The light emitting diodes 700*a*, 700*b*, 700*c* respectively output the lights corresponding to R, G, B colors to the liquid crystal display panel, and the light source controller 800 controls a turn on/off timing of light emitting diodes 700*a*, 700*b*and 700*c*. At this time, according to the exemplary embodiment of the invention, the timing to supply the corresponding gray scale waveforms from the data driver 300 to the data lines can be synchronized with the timing for the light source to turn on the R, G, and B light emitting diodes in response to the control signals generated by the timing controller 500.

Figure 5:
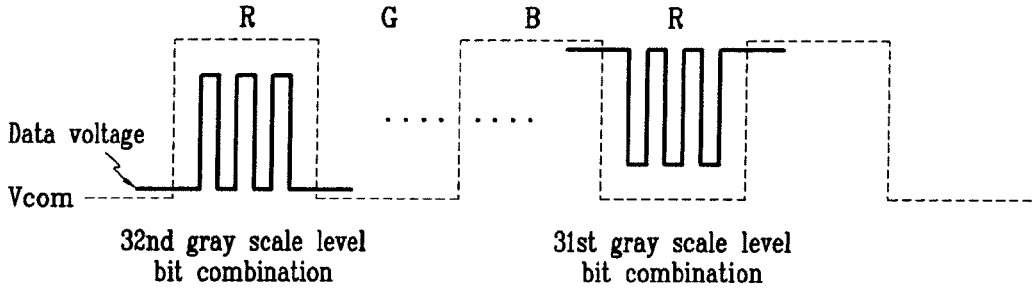
FIG. 5 shows a waveform of the liquid crystal display device according to an exemplary embodiment of the present invention.

FIG. 5 shows a waveform of the liquid crystal display device according to an exemplary embodiment of the present invention.

With reference to FIG. 5, a first gray scale waveform corresponding to first gray scale data and a first common voltage are applied to the first pixel at the field of the current frame, and a second gray scale waveform corresponding to the second gray scale data, which has a gray scale level that is lower by one level than a gray scale level of the first gray scale data, and a second common voltage are applied to the field of the next frame in order to display a gray scale which is half-way between gray scale levels corresponding to the first and second gray scale data. In other words, a gray scale level which is half-way between the gray scale level of the first gray scale data and the gray scale level of the second gray scale data is perceived by the viewer. For example, since common voltage Vcom has inversion driving, that is, the first common voltage is inverse to the second common voltage at FS-LCD, the 32nd grayscale level (the first gray scale data) is used at the R field then the 31st grayscale level (the second gray scale data) is used at the next R field so that a grayscale level of 31.5 can be realized. Different grayscale levels are alternately applied depending on the voltage states including the positive voltage and the negative voltage, thereby realizing gray scale levels that are half-way between two adjacent gray scale levels that can normally be achieved using a predetermined number of bits in a digital driving method. Similarly, the grayscale levels having the difference of one level appear in the case when the Vcom is alternatively the positive (+) voltage or negative voltage (−) to realize gray scale levels that are half-way between two adjacent gray scale levels normally represented by the predetermined number of bits at all R, G, B fields. According to the exemplary embodiment of the present invention, 64 grayscale levels can be realized using frame rate modulation (FRM) by realizing the half-way levels of 32 grayscale levels so that milder images (i.e., images having more smooth transitions between gray scale levels or pixel intensities) can be displayed. In other embodiments, the second gray scale data may have the 32nd gray scale level while the first gray scale data has the 31st gray scale level. In other words, the second gray scale data may have a gray scale level which is one level higher than the gray scale level of the first gray scale data.

Figure 6:
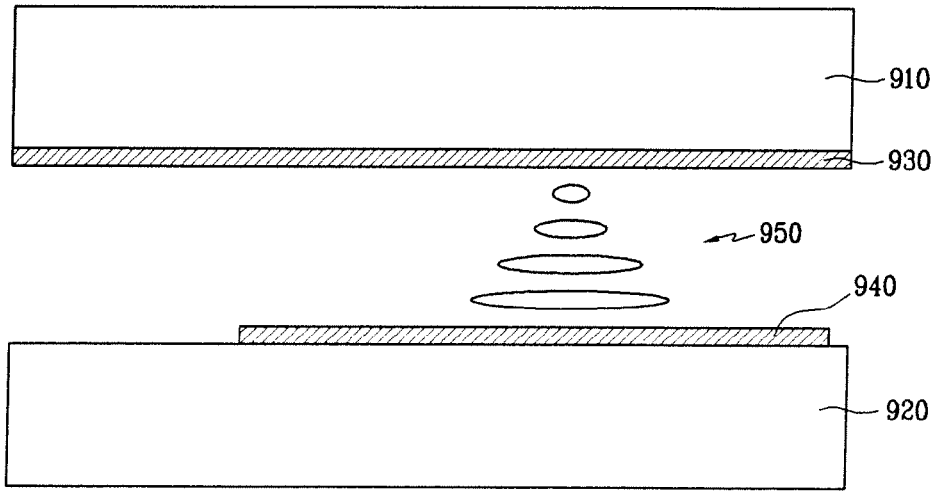
FIG. 6 illustrates a conceptual diagram of a pixel of a TFT-LCD.

FIG. 6 illustrates a conceptual diagram of a pixel of a TFT-LCD. The pixel includes a liquid crystal 950 disposed between a first substrate 910 and a second substrate 920, a first electrode (common electrode) 930 arranged at the first substrate 910, and a second electrode (pixel electrode) 940 arranged at the second substrate 920. Exemplary embodiments of the present invention can be applied to the pixel of FIG. 6, as well as to other suitable pixels. In addition, the first and second substrates 910, 920 and the liquid crystal 950 may be equivalently represented, for example, as the liquid crystal capacitor Cl in FIG. 1.

While the present invention has been described in connection with certain exemplary embodiments, it is to be understood that the present invention is not limited to the disclosed embodiments, but, on the contrary, is intended to cover various modifications and equivalent arrangements included within the spirit and scope of the appended claims, and equivalents thereof.

What is claimed is:

1. A driving method of a liquid crystal display, wherein the liquid crystal display includes a plurality of scan lines, a plurality of data lines crossing the scan lines, and a plurality of pixels formed at areas defined by the scan lines and the data lines and coupled respectively to the scan lines and the data lines, each pixel having a switch, and R, G, and B color lights are sequentially applied to the pixels, the method comprising:

for each of R, G, and B fields in which the R, G, and B color lights are respectively applied, applying a first common voltage and a first gray scale waveform corresponding to first gray scale data to a first pixel among the plurality of pixels in the field of a current frame; and displaying a gray scale which has a level half-way between gray scale levels of the first gray scale data and second gray scale data by applying a second common voltage and a second gray scale waveform corresponding to the second gray scale data to the first pixel in the field of a next frame, the gray scale level of the second gray scale data being different from the gray scale level of the first gray scale data by one level.

2. The driving method of a liquid crystal display device of claim 1, wherein the first and second common voltages are alternately applied per field, wherein the second common voltage is lower than a voltage of the second gray scale waveform when the first common voltage is higher than a voltage of the first gray scale waveform.

3. The driving method of a liquid crystal display device of claim 1, wherein the first and second common voltages are alternately applied per field, wherein the first common voltage is lower than a voltage of the first gray scale waveform when the second common voltage is higher than a voltage of the second gray scale waveform.

4. The driving method of a liquid crystal display device of claim 1, wherein the gray scale level of the second gray scale data is lower than the gray scale level of the first gray scale data by the one level.

5. A driving method of a liquid crystal display device having a plurality of pixels, wherein liquid crystal is disposed between a first substrate and a second substrate, and R, G, and B color lights are sequentially transmitted through the liquid crystal, the method comprising:

(a) applying a first common voltage and a first gray scale waveform corresponding to first gray scale data to a first pixel among the plurality of pixels in a field of a current frame;

(b) displaying a gray scale having a level which is half-way between gray scale levels of the first gray scale data and second gray scale data by applying a second common voltage and a second gray scale waveform corresponding to the second gray scale data to the first pixel in the field of a next frame, the gray scale level of the second gray scale data being different from the gray scale level of the first gray scale data by one level.

6. A driving method of a liquid crystal display device of claim 5, wherein the gray scale level of the second gray scale data is lower than the gray scale level of the first gray scale data by the one level.

7. A liquid crystal display device comprising:

a liquid crystal display panel including a plurality of scan lines for applying scan signals, a plurality of data lines crossing the scan lines, a plurality of pixels formed at areas defined by the scan lines and the data lines and coupled respectively to the scan lines and the data lines, each pixel comprising a switch and a capacitor having one side coupled to the switch and the other side coupled to a common electrode;

a scan driver for supplying the scan signals to the scan lines;

a gray scale voltage generator for generating a first gray scale voltage corresponding to first gray scale data for a first pixel among the pixels at a field of a current frame, and for generating a second gray scale voltage corresponding to second gray scale data for the first pixel at the field of a next frame, the second gray scale data having a gray scale level which is different by one level from a gray scale level of the first gray scale data, so as to display a gray scale which has a level that is half-way between the gray scale levels corresponding to the first and second gray scale data;

a common voltage generator for generating first and second common voltages, and for applying the first common voltage to the common electrode when the first gray scale data is applied, and applying the second common voltage to the common electrode when the second gray scale data is applied;

a data driver for supplying first and second gray scale waveforms of the first and second gray scale voltages generated by the gray scale voltage generator to corresponding data lines; and a light source for applying R, G, and B color lights sequentially to the pixels.

8. The liquid crystal display device of claim 7, wherein the first and second common voltages are alternately applied per field, wherein the first common voltage is lower than a voltage of the first gray scale waveform when the second common voltage is higher than a voltage of the second gray scale waveform.

9. The liquid crystal display device of claim 7, wherein the gray scale level of the second gray scale data is lower than the gray scale level of the first gray scale data by the one level.

* * * * *